US005885069A

United States Patent [19]

Rogelet

[11] Patent Number: 5,885,069

[45] Date of Patent: Mar. 23, 1999

[54] LIGHTER

[75] Inventor: Thierry Rogelet, Lyons, France

[73] Assignee: Cricket S.A., Rillieux-la-Pape, France

[21] Appl. No.: 836,612

[22] PCT Filed: Oct. 3, 1996

[86] PCT No.: PCT/IB96/01139

§ 371 Date: May 15, 1998

§ 102(e) Date: May 15, 1998

[87] PCT Pub. No.: WO97/27431

PCT Pub. Date: Jul. 31, 1997

[30] Foreign Application Priority Data

Jan. 24, 1996 [FR] France ..... 96 01024

[51] Int. Cl.[6] ..... F23D 11/36

[52] U.S. Cl. ..... 431/153; 431/255

[58] Field of Search ..... 431/153, 255

[56] References Cited

U.S. PATENT DOCUMENTS

| | | | |
|---|---|---|---|
| 5,145,358 | 9/1992 | Shike et al. | 431/255 |
| 5,228,849 | 7/1993 | Frigiere | 431/153 |
| 5,462,432 | 10/1995 | Kim | 431/153 |

FOREIGN PATENT DOCUMENTS

| | | |
|---|---|---|
| A-0 488 158 | 6/1992 | European Pat. Off. . |
| A-0 670 455 | 9/1995 | European Pat. Off. . |
| A-2 675 885 | 10/1992 | France . |
| U-8802582.9 | 5/1988 | Germany . |
| WO 90/12254 | 10/1990 | WIPO . |

*Primary Examiner*—Carroll B. Dority
*Attorney, Agent, or Firm*—Oliff & Berridge, PLC

[57] ABSTRACT

A lighter actuated by a push-control member (24) which can move in a longitudinal direction, and which resists use by children, comprising a lighter-body (2) and lighting means comprising said push-control member. The push-control member (24) is guided in two essentially perpendicular directions, a longitudinal direction (36) in relation to the lighter body (2) and a transverse direction (38, 56, 60) in relation to the lighter body (2). The push-control member (24) has an abutment face (34, 46, 52, 53) which is normally opposite a counter-abutment surface (34, 44, 2) integral with the lighter-body (2), and the push-control member (24) is displaceable in the transverse direction (38, 56, 60) such that its abutment face is then in a non-active position relative to its counter-abutment surface. Elastic means (40, 54, 58, 41, 62) comprising an elastic tongue member extending longitudinally and deformable transversely in accordance with transverse movement of the push-control member (24), act in a transverse direction (38, 56, 60) to return the abutment face of the push-control member to a position opposite the counter-abutment surface, means being provided to return the push-control member (24) into a position of rest in the longitudinal direction. Said elastic means may comprise a U-shaped metallic strip, one branch of which being elastically deformable, the second branch acting as an electrode forming electrical contact with the conductive material of a piezoelectric lighting system.

9 Claims, 9 Drawing Sheets

LIGHTER

Figure 1:
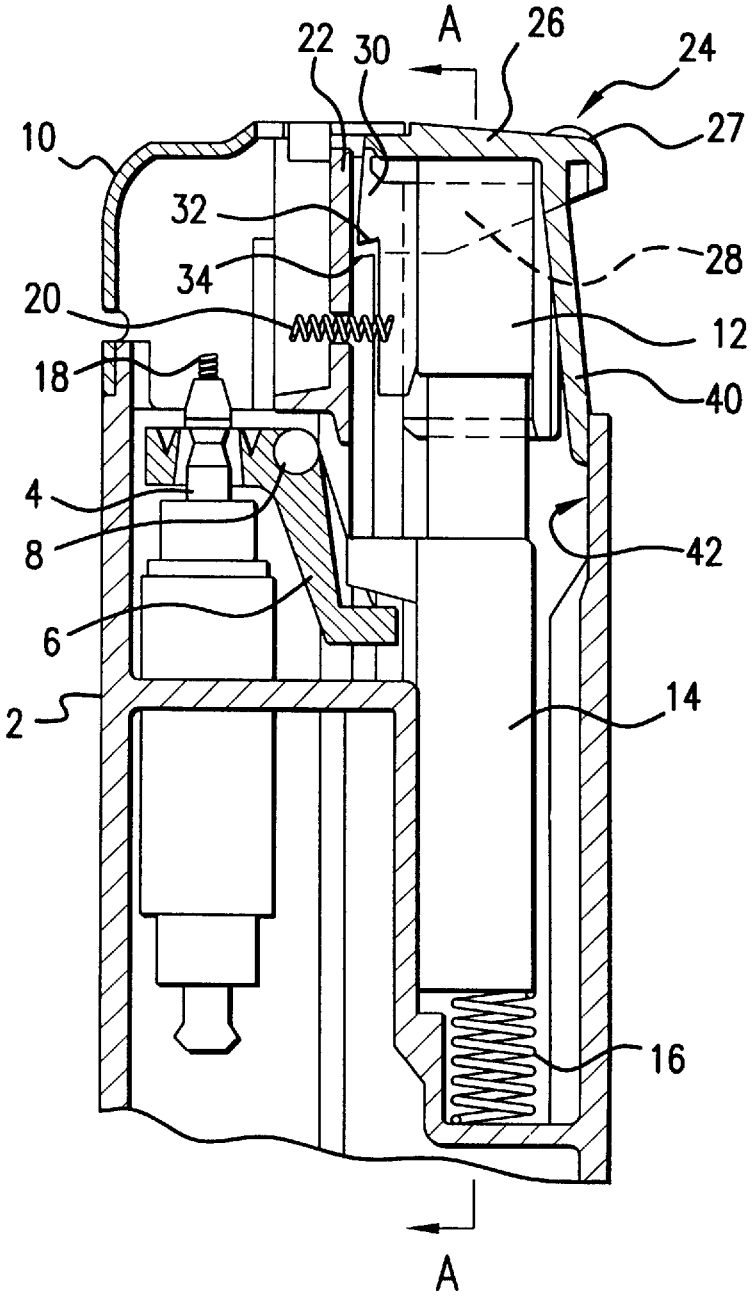

The present invention concerns a lighter which is actuated by a push-control means which can be moved in a longitudinal direction, and resists use by children. This type of activation is found, for example, in piezoelectric lighters, and also with a lighting mechanism of a kind comprising a pyrophoric stone and a knurling wheel. By pressing on a push-control, a user of this lighter simultaneously controls production of a spark and opening of a valve through which gas escapes, thereby enabling formation of a flame.

This type of lighter is very simple to use as it is only necessary to press on a push-control to create a flame. Attempts are therefore being made to make it more difficult to use such lighters so that children of less than five years in age cannot produce a flame with them.

It is known for lighters of this type, resisting use by children, to be produced.

In these lighters, there are means of neutralising the associated lighting mechanism, these means being mobile between an active position of neutralisation in which they prevent actuation of the lighting mechanism, and a non-active position in which they allow this actuation, it being possible for a user to manually move these mobile means from their active position of neutralisation to their non-active position.

This type of lighter is particularly known from a German utility model 88 02 582.9. However, in this lighter, neutralisation means concerned are not implemented to be automatically returned to an active position of neutralisation after actuation of a lighting mechanism concerned.

This return into an active position can therefore only be obtained by their operation in a reverse direction by a user.

It is easy to imagine that merely forgetting this latter operation completely negates advantages associated with presence of neutralisation means.

Document WO 90/12254 shows a gas-lighter with a lighting mechanism comprising means of controlling opening of a burner valve and means of producing sparks. In this lighter with a lighting mechanism, there are associated means of neutralising this mechanism which are mobile between an active position of neutralisation of a lighting mechanism concerned and a non-active position, these neutralisation means being manually movable, by a user, from their active position to their non-active position. Means of neutralising lighting are normally kept in a neutralising position and are, moreover, implemented to be automatically returned to a neutralising position, after actuation of a lighting mechanism concerned.

Although fully satisfactory concerning its functioning, a lighter in accordance with a latter document has a drawback of requiring presence of supplementary parts, making its assembly more complex and increasing, by a substantial extent, its break-even-point.

To overcome these drawbacks, a French patent FR 2 675 885 provides a lighter in which a control member is mounted such that it can slide and is provided with a skirt. An elastically deformable tongue is cut into this skirt such that, in an area of its free rim, there is an abutment face normally opposite a counter-abutment surface which is part of the body of the lighter concerned, this tongue being elastically and transversally movable such that its abutment face is brought into a non-active position in relation to a counter-abutment surface of the said body and therefore allowing pressing down of an actuating section of the control member in the direction of its lighting operation.

This lighter has the drawback of having to first act on a said tongue, and then on a control member, in order for a flame to be obtained. It is therefore necessary to act at two points to use a lighter concerned.

The present invention is therefore aimed at providing a lighter which can be used by an adult, yet which is difficult for a child to use, particularly a child of less than five years of age. Another aim is to supply an impregnable safety-system, that is, one held in a neutralisation position. In addition, unlocking is to occur at the same point as lighting action.

To this end, the present invention puts forward a lighter actuated by a push-control member which can move in a longitudinal direction, and which resists use by children, of a type comprising a lighter-body and lighting means comprising a push-control member. This lighter is characterised in that the push-control member concerned is guided in two essentially perpendicular directions, a first direction which is longitudinal in relation to the said lighter-body and a second direction which is transverse in relation to the same body, and in that the said push-control member is provided with an abutment face which is normally opposite a counter-abutment surface forming part of the said lighter-body, and in that the said push-control member can be moved in a transverse direction such that its abutment face is then in a non-active position in relation to its counter-abutment surface, and in that elastic means act in a transverse direction to return the said abutment face of the push-control member to a position opposite the said counter-abutment surface, means being provided to return the said push-control member into a position of rest in the longitudinal direction concerned.

So, thanks to surfaces of abutment and counter-abutment and to their relative positions, it is not possible to actuate the said push-control member in a longitudinal direction, from a normal position or position of rest. It is therefore necessary to move this push-control member transversely before moving it in a longitudinal direction. Said transverse movement makes it possible to render the surfaces of abutment and counter-abutment inactive. To actuate the lighting mechanism of the lighter concerned, the user only needs to place a finger or thumb on the upper face of the push-control member to push this in a transverse direction (this movement is possible either because of friction or because of an adapted form of the push-control member concerned) and then to press on the said push-control member in a longitudinal direction. It is therefore enough to act on one same section of the push-control member to operate the lighter.

Elastic means cause the said push-control member to automatically return to an idle position. Means of returning the push-control member concerned into an idle position in a longitudinal direction are already known and have been used for a long time with lighters actuated by a push-control member.

Said elastic means advantageously act on the push-control member on the side opposite the side carrying an abutment face.

The present invention offers several forms of implementation for elastic means returning a push-control member to its idle position in a transverse direction. In a first implementation, elastic means concerned comprise an elastic tongue-member, essentially extending in the longitudinal direction of the lighter-body, which can be deformed in a transverse direction by transverse movement of the push-control member and is integral with the push-control member.

In another implementation of a piezoelectric lighter, elastic means comprise an elastic tongue-member essentially extending in the longitudinal direction of the lighter, deformable in the transverse direction of movement of the push-control member and integral with the electrode carrier. Advantageously, the said elastic tongue-member, mounted on the electrode-carrier, parts from this carrier and moves away from it upwardly. This arrangement enables the tongue-member to be idle when the push-control member is in an idle position and when it is at the end of its course. The said tongue-member is therefore only constrained when the push-control member is moved and is located in an intermediate position.

In an advantageous implementation of a piezoelectric lighter, elastic means comprise a metal strip, which is essentially U-shaped, carried by a wall which is part of the lighter body and positioned nearly parallel to the wall of the said push-control member, one of the branches of the said blade being supported against the wall of this push-control member and being elastically deformable, the second branch being curved at its end and acting as an electrode, and the piezoelectric lighting mechanism concerned has at least one section made from conductive material such that it can create an electrical link with the elastic strip at the end of the longitudinal course of the push-control member.

For this latter variation, elastic means concerned are connected neither to a push-control member nor to the body of the lighter concerned, comprising instead an independent piece which also, cleverly, functions as an electrode.

The present invention also offers designs for implementing abutment and counter-abutment surfaces. So, in a first variation, an abutment face is realised as a shoulder of a push-control member. A counter-abutment surface can then be a shoulder member implemented as a wall-section of the lighter body, or it can comprise a rim of the said lighter-body.

In another form of implementation, the face of counter-abutment is a top of a rib which runs essentially longitudinally, and the said push-control member includes a wall-member forming a projection, parallel to the said rib-member, with a height whereby, when a push-control member is moved in a transverse direction, from its idle position, it does not come up against the said rib, and placed such that when the said push-control member is moved from its idle position in a longitudinal direction, an internal surface of a wall-member concerned, forming a projection, slides along the said rib-member.

In this latter variation, if, instead of first moving the push-control member concerned in a transverse direction, it is first of all displaced in a longitudinal direction, it is thus in the locked position and it is therefore necessary to let it return to the idle position to be able to use the lighter. Thus, as for other forms of implementation of a lighter in accordance with the present invention, the push-control member only allows lighting of the lighter when sequences to slide the said push-control member are correctly carried out.

The rib-member concerned can be an element added to the lighter-body, or it can be a rib-member which is already present on a lighter-body of preceding state of the art, such as, for example, the wall of a said lighter-body.

In these various implementations, longitudinal guiding of the push-control member is advantageously implemented with the aid of a system of ribs, each of which is associated with a groove, a said push-control member being provided with two rib-members and the lighter-body concerned being provided with two corresponding grooves, said grooves stopping below said rib members in the idle position of the push-control member and being shifted transversely in relation to these, such that ribs concerned are engaged in grooves when the push-control member has been moved transversely and starts its longitudinal course.

Of course, the grooves concerned can be formed on the push-control member and the rib-members concerned can be formed on the lighter body. There is, therefore, the same relative shift between rib-members and grooves, rib-members concerned then being located below grooves in the idle position of the push-control member.

Nevertheless, the present invention will be well understood with the aid of the description that follows, referring to an annexed diagrammatic illustration, representing, in non-limiting terms, several implementations of a lighter in accordance with the present invention.

Figure 3:
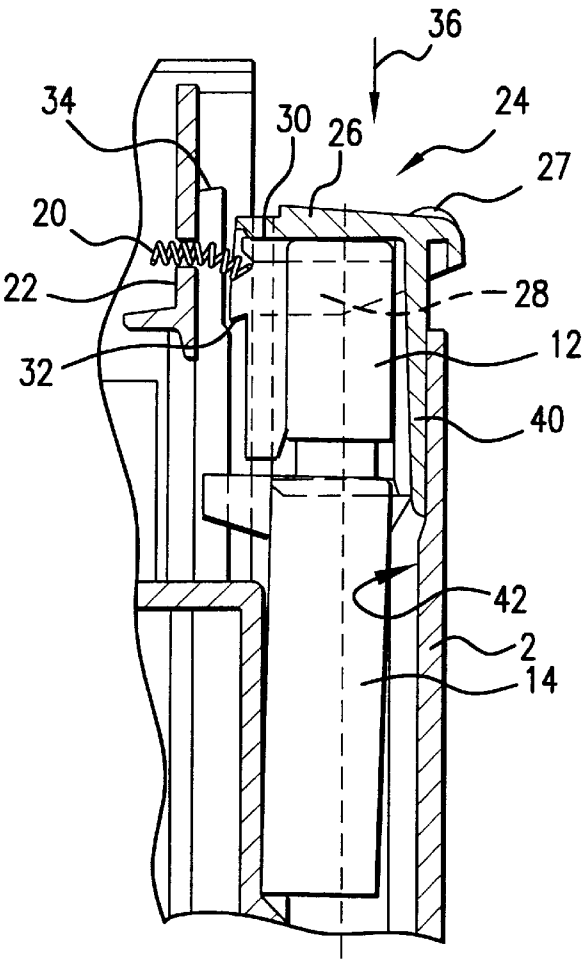
Figure 2:
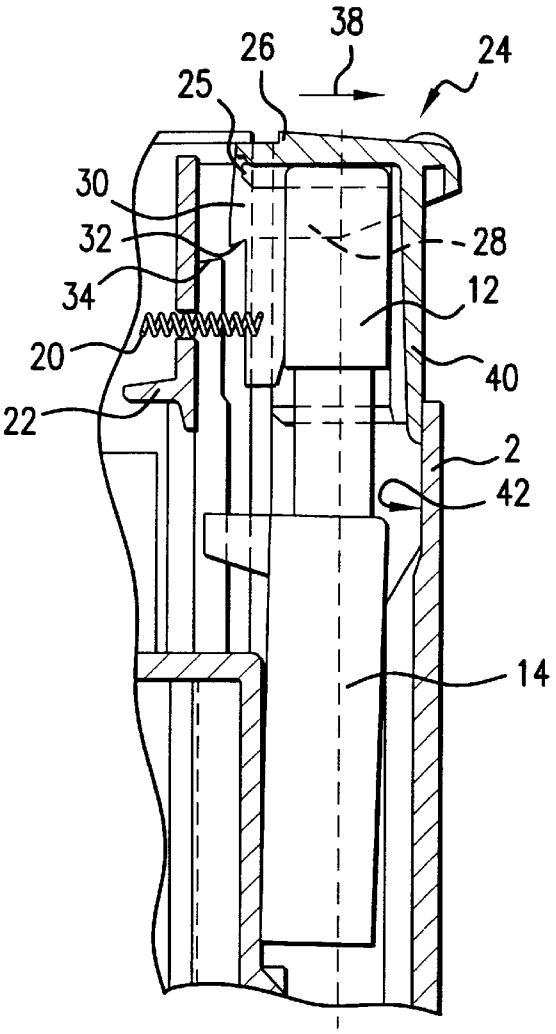
Figure 7:
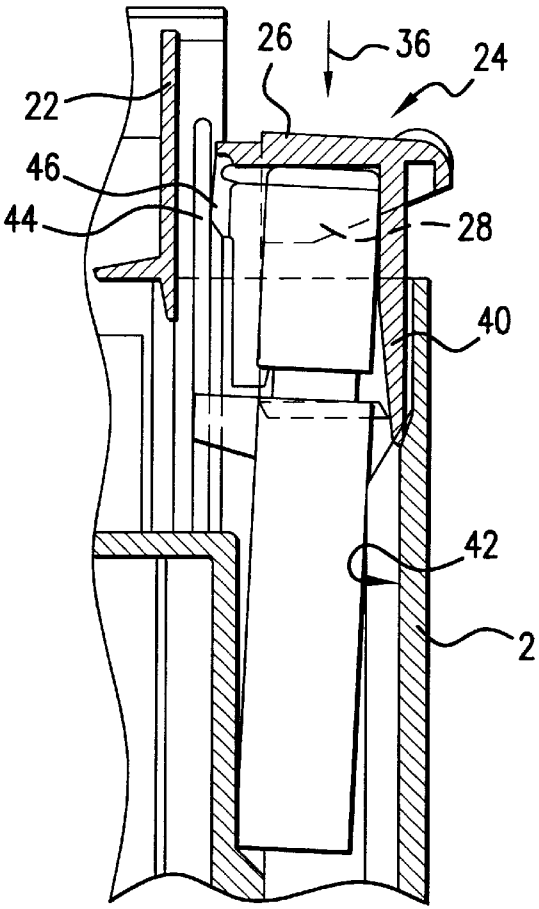
Figure 6:
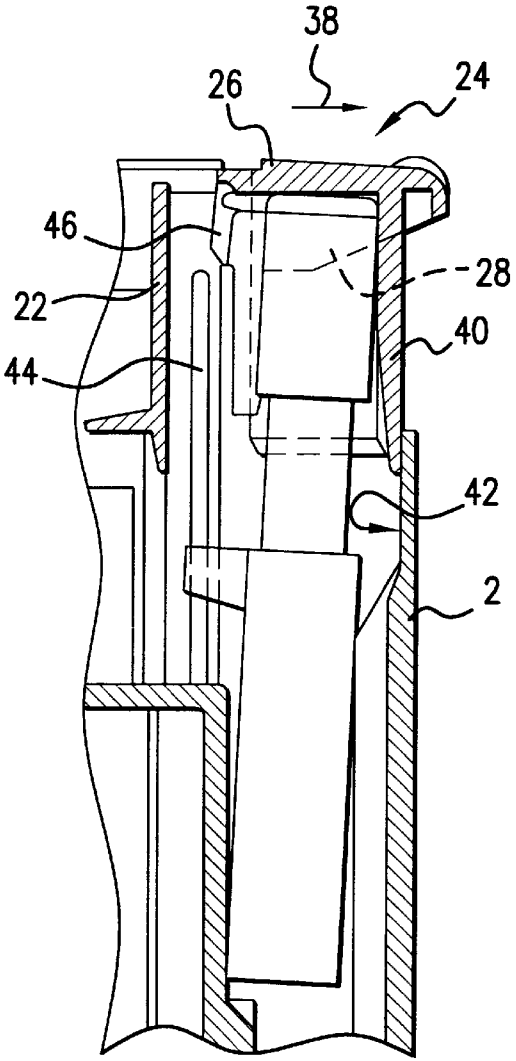
Figure 10:
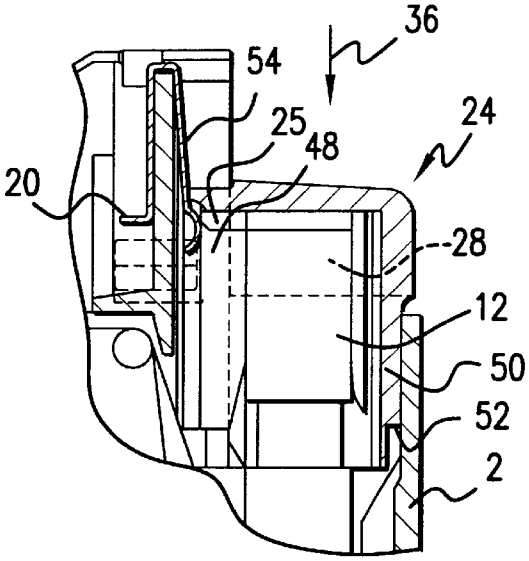
Figure 9:
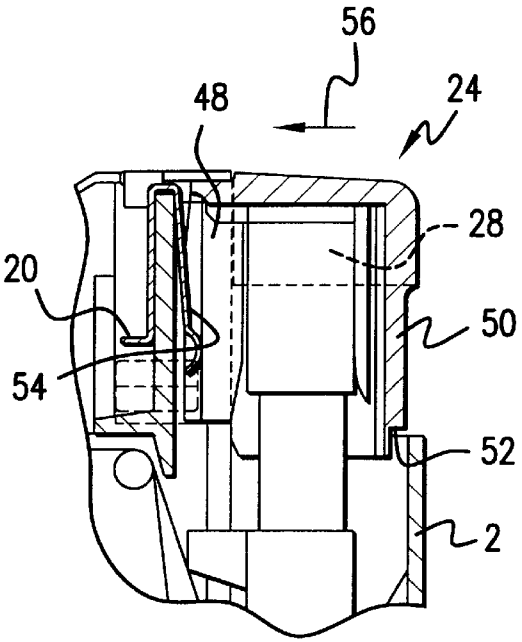
Figure 8:
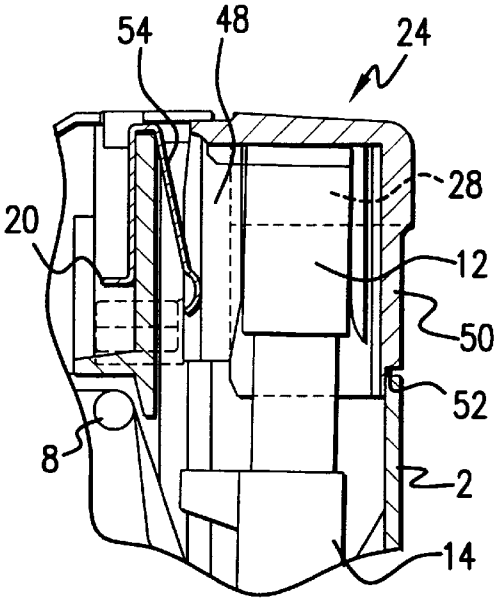
Figure 13:
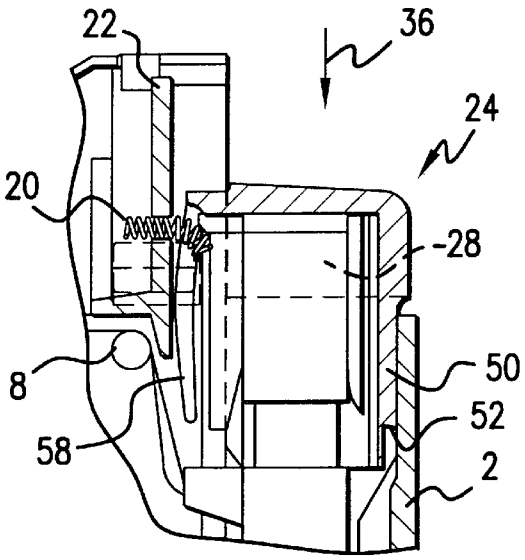
Figure 12:
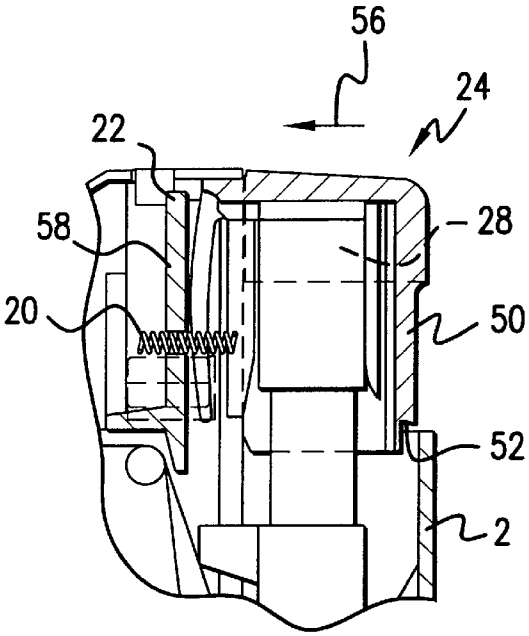
Figure 11:
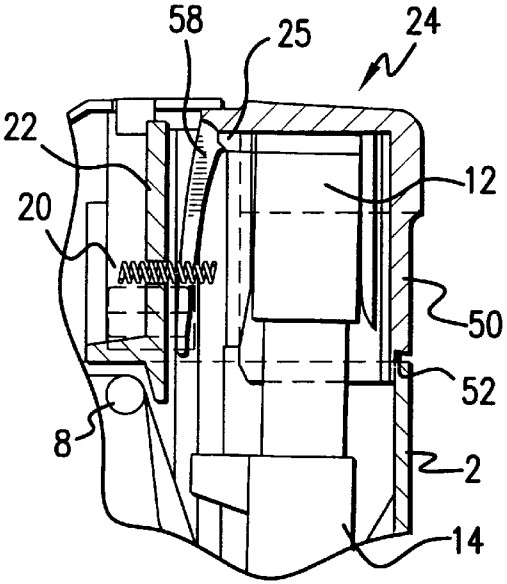
Figure 16:
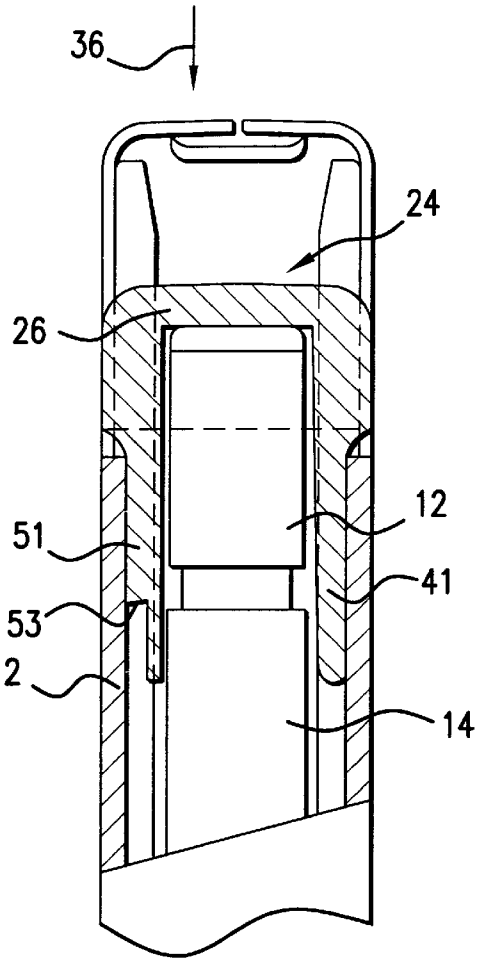
Figure 15:
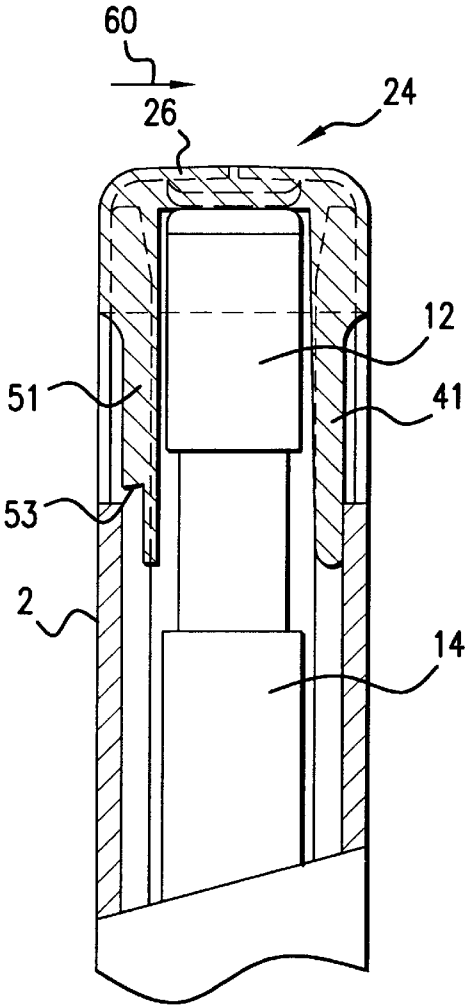
Figure 14:
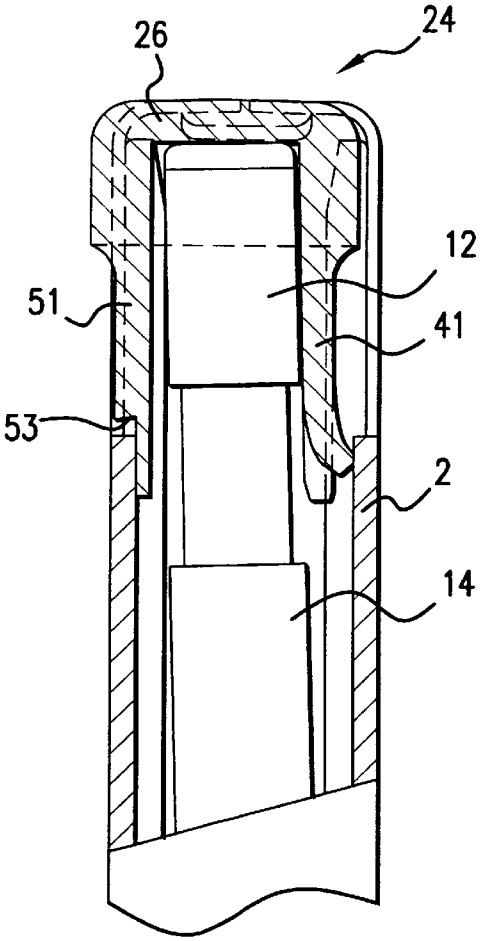
Figure 17:
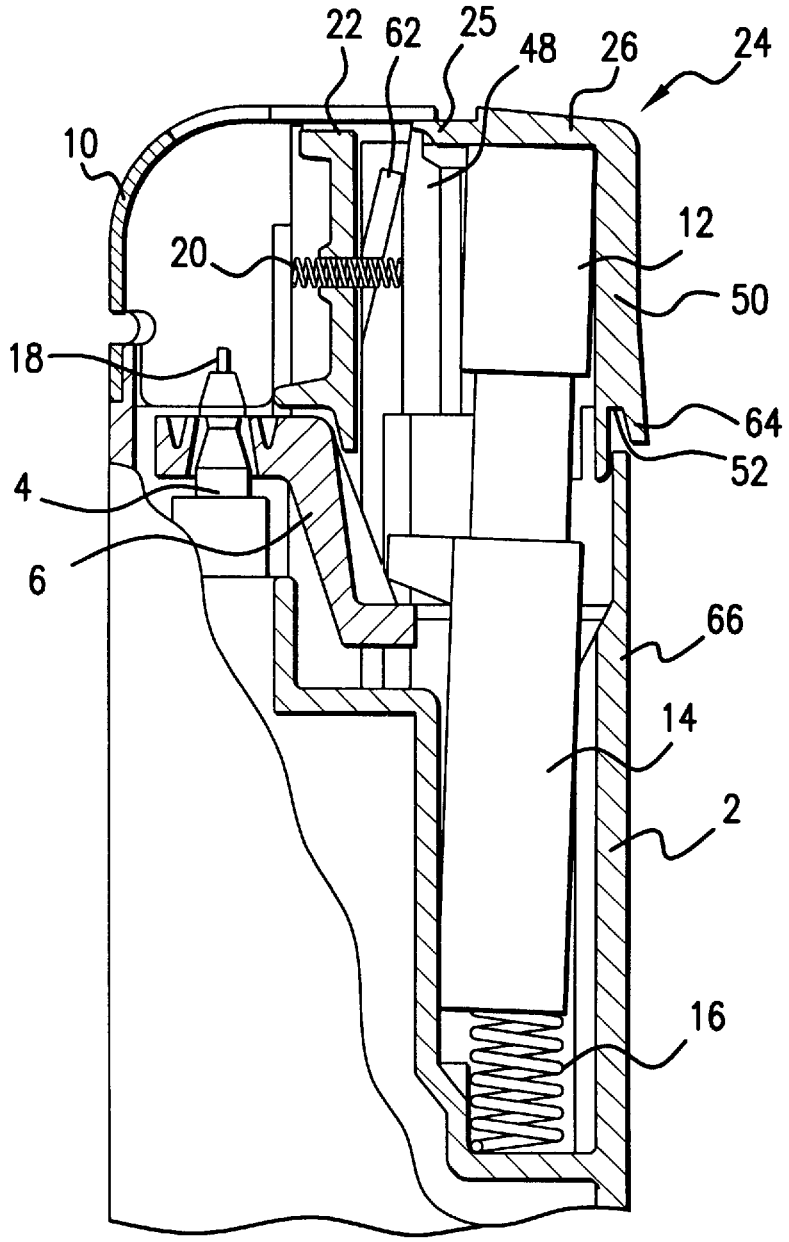
Figure 19:
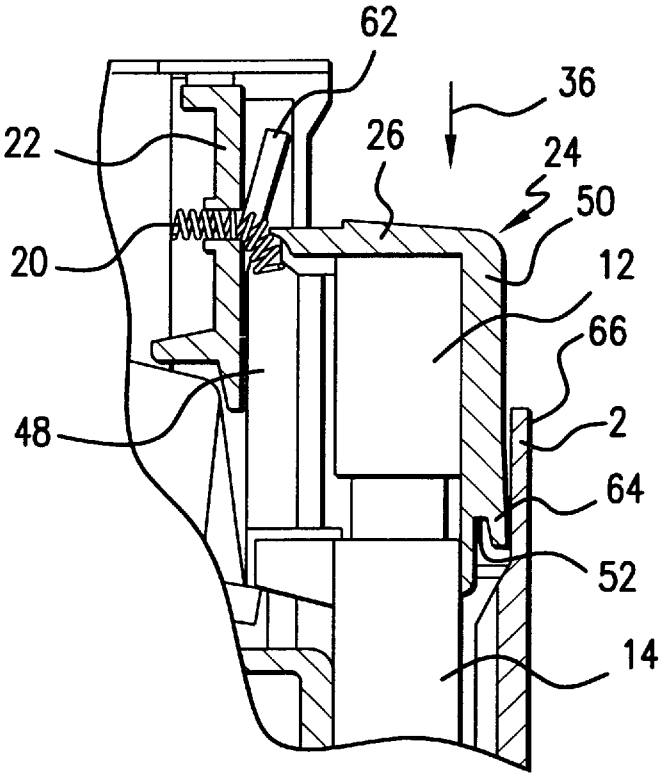
Figure 18:
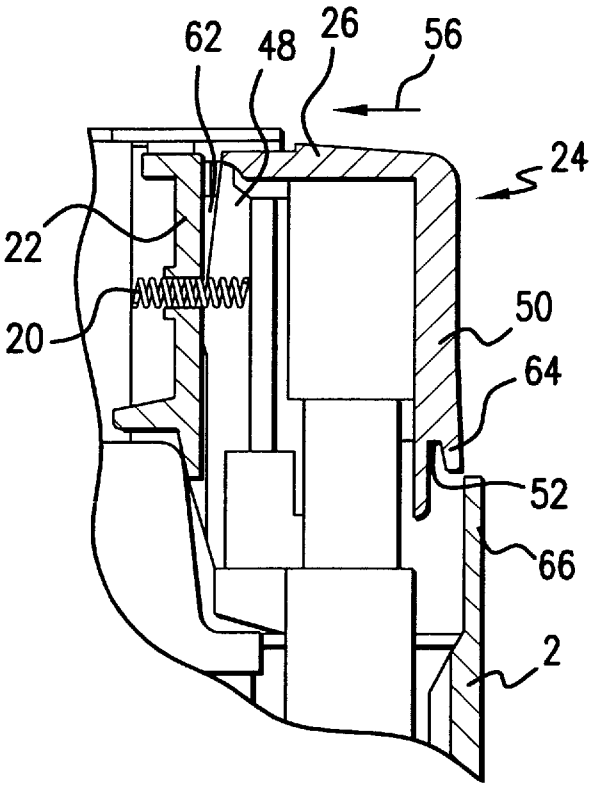

FIGS. 1 to 3 are partial longitudinal sections of a first implementation, in three successive, different positions during lighting of the lighter, FIGS. 4 to 7 are partial longitudinal sections of a second implementation showing different positions of means of controlling lighting of the lighter, FIGS. 8 to 10 are partial longitudinal sections of a third implementation in three successive positions, FIGS. 11 to 13 correspond to a fourth implementation, likewise shown as a partial longitudinal section, FIGS. 14 to 16 are sectional views along line A—A in FIG. 1, though for a fifth implementation, and FIGS. 17 to 19 are partial longitudinal sections of a sixth implementation.

These diagrams show partly different implementations of a gas-lighter. Such a lighter has a body 2 functioning as a reservoir to hold the fuel of liquefied petroleum gases.

On its upper part, the said reservoir is provided with a burner 4 which includes a valve enabling gas to escape when it is in an open position. A control lever 6, mounted pivoting about a transverse axis 8, controls opening and closure of the valve of the burner 4. A protection cover-member 10 enables protection from wind of the upper part of the burner 4 to enable the creation of a flame.

In the various implementations shown, the lighter shown is one including a piezoelectric-type lighting mechanism. This mechanism includes, in a known way, an upper section 12 which is moveable in the direction of a lower part 14, set against the force of a return spring which cannot be seen in annexed diagrams. A second spring 16 is placed between the lower section 14 and the lighter body and acts longitudinally (FIG. 1). Moreover, two electrodes are provided. A first electrode 18 comprises the upper end of the burner and a second electrode 20 is mounted on an electrode-carrier 22 close to the said first electrode 18.

The said electrode-carrier 22 has a known structure and is conventionally mounted.

The lighter-control member concerned comprises a push-control member 24 overlapping the moving upper section 12 of the said lighting mechanism. This push-control member 24 is moved, in relation to a body of a lighter 2, by the person using a lighter.

When a user puts pressure on the push-control member 24, this produces movement of the lower section 14 against the spring 16, and also produces a movement of the mobile section 12 towards the said lower section 14. Movement of this lower section 14 produces, first, opening of a valve integrated into the burner 4, and setting up of an electrical contact with the first electrode 18, whilst movement of the mobile section 12 towards the lower section 14 afterwards produces a spark.

The moving section 12 of the mechanism concerned also includes an anvil-shaped form on the side facing the push-control member 24, that is, on its upper face. This anvil-form 25 is made of conductive material such as, for example, zinc mixed with aluminium, magnesium and copper. When the push-control member 24, and therefore also the moving section 12 of the lighting mechanism, is moved longitudinally and arrives at the end of its course, an anvil-shaped member 25 sets up an electrical contact between the electrode 20 and the lighting mechanism.

To enable longitudinal movement of the push-control member 24, the face of this positioned opposite the electrode-carrier 22 has a groove, extending in a longitudinal direction, which accommodates the end of a second electrode 20. Thus, when the push-control member 24 moves, the electrode 20 can slide in relation to the push-control member 24 in the said groove.

FIGS. 1 to 3 show a first implementation in accordance with the present invention. The push-control member 24 is in a normal position, or idle position in FIG. 1, that is, a user exerts no force on this push-control.

The said push-control member 24 has an upper face 26 on which a user can act. This upper face 26, which is perpendicular to the plane of this diagram, supports two parallel, lateral walls 28 in the plane of this diagram, one in front of this plane, and one behind it. A wall member 30 extends longitudinally between two said side walls 28 and is connected to the upper face 26. The upper section 12 of the lighting-mechanism concerned is accommodated between these walls.

The wall 30 has, on its surface facing the burner 4, a step 32 forming a shoulder. Facing this wall 30, there is an electrode-carrier 22 which is fixed to the body of the lighter 2. This latter includes a rib-member 34 extending along the said electrode-carrier 22, although not over all of the height of this carrier. The said rib-member 34 faces the shoulder 32 such that they form an abutment surface and a counter-abutment surface, limiting movement in the longitudinal direction of the push-control member 24 (arrow 36).

The said rib-member 34 can be an integral part of the body of the lighter 2, or it can be replaced by a shoulder implemented level with the electrode-carrier 22, facing the shoulder 32.

So that the push-control member 24 can act on the lighting-mechanism, it is necessary to separate the wall member 30 from the electrode-carrier 22.

The said push-control member is then moved transversely in relation to the body of the lighter 2, as indicated by an arrow 38 in FIG. 2. A small bulge 27 implemented on the upper face of the push-control member 26 on a rim opposite the electrode 20, facilitates movement whilst acting as an abutment means for the user's finger.

This movement is made against the elastic force of the tongue member 40. This latter runs essentially parallel to the wall member 30 of the push-control member, and is located between two lateral walls 28 and is connected to the upper surface 26. The free end of this tongue member is supported on an interior face 42 of the lighter body.

Once the push-control member 24 is in the position shown in FIG. 2, it can be moved in the direction of the arrow 36 of FIG. 3 and act on the lighting mechanism concerned. When the user releases the said push-control member 24, it automatically returns to the position shown in FIG. 1, under the action of the return spring 16, and of a spring, not shown in the drawing, between the upper and lower sections 12 and 14 of the said lighting mechanism, and by the tongue-member 40.

The push-control member 24 is guided in two directions (arrows 36 and 38) in relation to the lighter-body 2 due to, amongst other things, the wall 30 and the tongue-member 40. For longitudinal guiding (arrow 36), a system of rib-members each associated with a groove can be provided. Such a system exists on lighters of preceding state of the art. The push-control member 24 is provided with two longitudinal rib-members and the body of the lighter concerned is provided with two corresponding grooves. In a lighter in accordance with the present invention, the grooves concerned stop below rib-members of the push-control member when this latter is in an idle position, and they are shifted in relation to these in this same position. Grooves concerned are only positioned opposite rib-members if the push-control member has been moved transversely (arrow 38).

FIGS. 4 to 7 show a second implementation of a lighter in accordance with the present invention.

In this implementation, there is a push-control member 24 comprising an upper face 26, two lateral wall-members 28 and a tongue member 40. Differences in relation to the preceding implementation relate to abutment and counter-abutment faces.

A rib-member 44 extends approximately parallel to the axis of the lighter body 2, between the lighting mechanism and the burner 4. In the idle position (FIG. 4), a given distance separates the top of the rib-member 44 from the upper face 26 of the push-control member. The latter comprises a wall forming a projection 46 extending between two lateral faces 28 and fixed below the upper section 26. The height of this projection 46 is less than the distance separating the top of the rib-member 44 from the upper face 26. This projection 46 runs parallel to the said rib-member 44, nevertheless is shifted in relation to this rib-member in the direction of the burner 4. The shift concerned essentially corresponds to the width of this rib-member 44.

Figure 5:
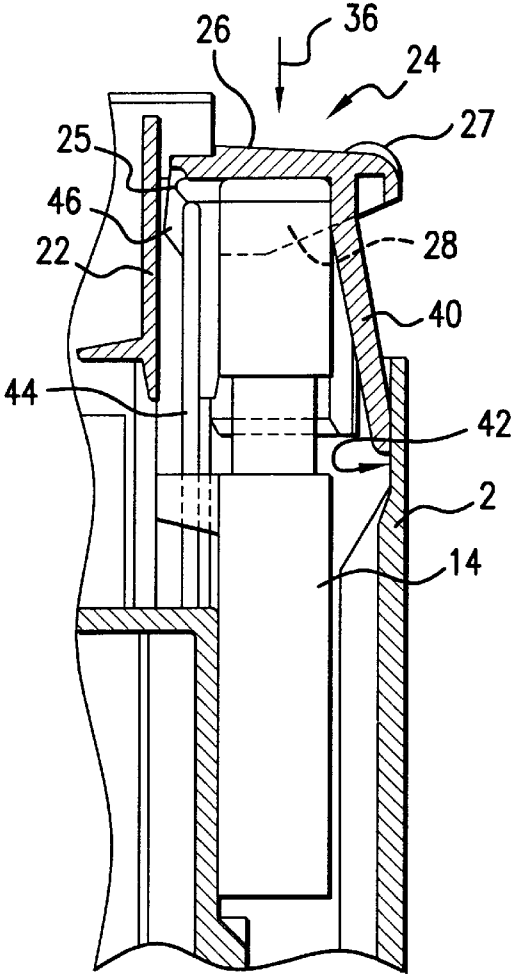
Figure 4:
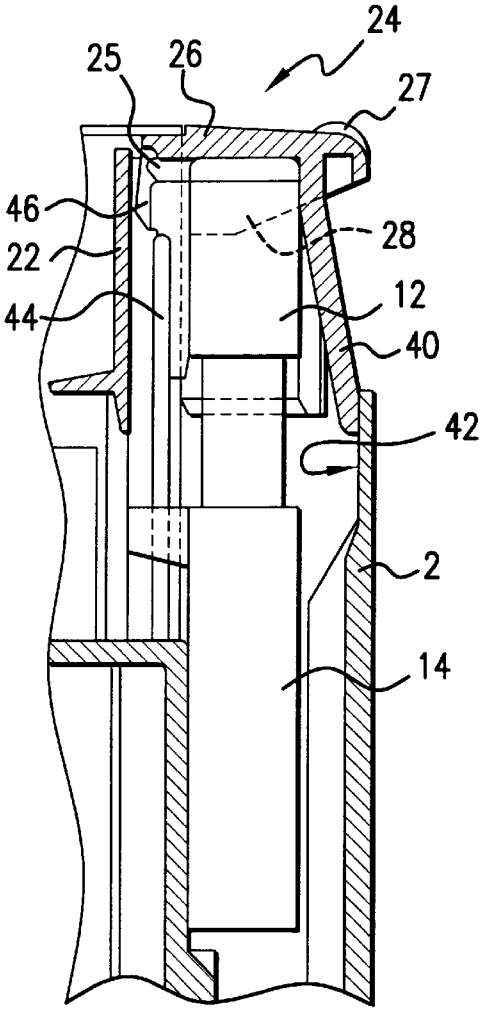

FIG. 5 shows the push-control member 24 in the position in which it is located when, from its normal position (FIG. 4), it is displaced in a longitudinal direction (arrow 36). The top of the rib 44 makes contact with the upper wall 26 of the push-control member. It is therefore impossible to continue movement of this push-control member in the direction of arrow 36, thereby preventing any actuation of the lighting mechanism concerned. To create a flame, it is necessary to release the push-control member which returns automatically to the normal, idle position (FIG. 4), and subsequently to move it in the direction of arrow 38 so as to bring a projection 46 from alongside the rib-member 44 and finally to press in the direction of arrow 36 to move the push-control member 24 longitudinally and so act on the lighting mechanism (FIG. 7). On releasing the push-control member 24, it automatically returns, under the action of the return spring and of the tongue-member 40, to a normal position as shown in FIG. 4.

A third implementation shown in FIGS. 8 to 10 comprises the push-control member 24 with its upper wall 26 and its lateral wall-sections 28 as described above. The said push-control member moreover comprises two wall-sections 48 and 50 extending longitudinally between two lateral wall-sections 28 connected to an upper wall-section 26. The first wall-section 48 is located alongside the burner 4 and the electrode carrier 22, and the second wall-section 50 runs essentially parallel to it, though on the opposite side.

The wall-section 50 is in an extension of the outer wall of the lighter body. Level with the rim of this body 2, it has a shoulder 52 and extends beyond this shoulder 52 to an interior of the lighter body 2. The said shoulder 52 thereby forms an abutment and the rim of the lighter body 2 forms a counter-abutment preventing the push-control member 24 from moving in the direction of arrow 36 (FIG. 10) from the idle position (FIG. 8).

The wall 48 runs parallel to the electrode-carrier 22 of the lighter and is located face-to-face with this. An elastic, metallic strip 54 is placed astride the electrode-carrier 22. From alongside the push-control member 24, this strip 54 which, overall, is in the form of an inverted U-shape, is supported against a wall 48. On the side of the burner, the strip 54 rests against the electrode-carrier 22 and its end is curved in the direction of the said burner 4. This end constitutes the second electrode 20.

Functioning of this lighter resembles that of the two other implementations. From the idle position (FIG. 8), it is necessary to bring an abutment 52 into a non-active position in relation to its counter-abutment by moving the push-control member 24 transversely in the direction of arrow 56, that is, towards the burner 4. This movement is made against force exerted by the elastic strip 54 which undergoes deformation. Once in the non-active position, the said push-control member 24 is moved downwards (arrow 36) to actuate the lighting mechanism concerned. At the end of its course, the anvil member 25 comes into contact with the elastic strip 54, thereby enabling the electrode 20 to be at the required potential.

By releasing the said push-control member 24, when it is in a position other than its idle position, it automatically returns to this idle position (FIG. 8) under the action of the return springs and of the elastic strip 54.

FIGS. 11 to 13 show a fourth implementation. Here, the push-control member 24 comprises an upper wall 26 and two lateral walls 28 as in the three other implementations concerned, and a wall-section 50 with a shoulder 52 functioning in combination with the rim of the lighter body 2 as in the third implementation (FIGS. 8 to 10).

Facing the electrode-carrier 22, the push-control member 24 comprises a tongue-member 58 provided with a groove in its centre to enable passage of a second electrode 20, as described initially in this description. This tongue-member 58 is essentially parallel to the wall section 50 and is connected to the upper wall-section 26 of the said push-control member. It extends longitudinally and is supported against the electrode-carrier 22 of the lighter.

Here there is functioning which is similar to that described in connection with FIGS. 8 to 10. Here, the functions of the elastic strip, namely of returning the push-control member 24 to a normal position (FIG. 11) and of functioning as an electrode, are separated. The electrode 20 is mounted in an electrode-carrier 22 such that it straddles this. With movement in the direction of arrow 36, the said electrode slides in relation to the groove of the elastic tongue-member 58 provided for this. When the push-control member 24 is in the lowered position, electrical contact between the lighting mechanism and the said electrode is likewise implemented via an anvil member 25.

As in the other implementations, there is a need to produce a transverse movement (arrow 56 of FIG. 12) to arrive in a position in which abutment and counter-abutment surfaces, of the push-control member and the lighter body, are non-active, before moving a said push-control member longitudinally (arrow 36 FIG. 13) to be able to actuate the lighting mechanism concerned.

The fifth implementation shown in annexed drawings (FIGS. 14 to 16) comprises the push-control member 24 with an upper wall member 26. The sectional plan view shown in FIGS. 14 to 16 is not the same as that of the other figures. It corresponds to a section line A—A in FIG. 1. A normal, or idle, position is shown in FIG. 14.

Wall-sections on the side of the burner and on the side opposite this burner are not shown as they do not have a particular function in terms of the present invention.

The lateral walls resemble elements already described above in reference to preceding figures. A wall-section placed to the left in FIGS. 14 to 16 is similar to wall-section 50 of FIGS. 8 to 13. Here it is marked by reference number 51 and its shoulder is marked 53. This shoulder 53 functions in combination with the rim of the lighter body 2 in the same way as the shoulder 52 in the third and fourth implementations.

A second lateral wall, placed to the right in FIGS. 14 to 16, is similar to the tongue-member 40 of FIGS. 1 to 7. Here it is marked 41 and is supported, like the said tongue-member 40, on an interior face 42 of the lighter body.

To be able to actuate the lighting-mechanism from the idle position (FIG. 14), it is necessary for the abutment face of the shoulder 53 to be in a non-active position in relation to the rim of the lighter body. The push-control member 24 is then moved first transversely to the right as shown in the figures, that is, in the direction of arrow 60 of FIG. 15. This movement is carried out with deformation of an elastic tongue-member 41 which then exerts a force, on the said push-control member, which tends to return this to its idle position. Once in this non-active position, the push-control member 24 can be moved so as to act on the lighting mechanism (FIG. 16).

As for implementations described further above, the push-control member 24 automatically returns to its idle position (FIG. 14) when no action is exerted on it, due to return springs and to the tongue-member 41. The final implementation shown in FIGS. 17 to 19 differs from other implementations shown in that elastic means tending to return an abutment surface into the face-to-face position in relation to the counter-abutment surface comprise a tongue-member 62 which is elastically deformable and integral with the electrode-carrier 22, and this tongue-member 62 is not constricted when the push-control member 24 is in the position (FIG. 19) controlling opening of the valve integrated into a burner 4.

The said push-control member 24 used in this implementation is similar to the push-control member shown in FIGS. 8 to 10. In relation to this implementation, an elastic strip 54 is replaced by an electrode 20, mounted on the electrode-carrier 22, and by a tongue-member 62. This tongue-member 62 parts from the electrode-carrier 22 in separating from this is in an upward direction. It is supported against wall-section 48 of the push-control member (FIGS. 17 and 18). The tongue-member 62 may be formed as part of the electrode-carrier 22, or fixed to the electrode-carrier 22, or alternatively it may also be provided as a separate independent component. As an independent component, the tongue-member 62 may be a leaf spring or alternatively in the form of a helical spring, or any other suitable spring shape, freely arranged between the electrode-carrier 22 and the push-control member 24. If the tongue-member 62 is provided as such a separate component, it may be retained in position by a suitable guide slot arranged on either the electrode-carrier 22 or any suitable part of the push-control member 24.

This implementation likewise includes a variation of the implementation shown in FIGS. 4 to 7. In view of this, the wall-section 50 of the push-control member comprises a shoulder 52 and also a projection 64 extending longitudinally downwards. A free end of this wall-section is therefore U-shaped. A space located between the branches of this 'U' faces, in the idle position, the rim 66 of the lighter body 2 (FIG. 17). It is sufficiently large to accommodate this rim 66, though, from an idle position, it is possible to transversely move the push-control member 24 without the projection 64 being an obstacle. Thus if, when the lighter concerned is used, the push-control member 24 is first moved longitudinally, no further transverse movement is possible without passing through an initial idle position.

In all forms of implementation described above, one sees that action of the lighting mechanism concerned requires a continued combination of two movements, making it very difficult for a young child to use. Nevertheless, an adult can use these lighters fairly easily and can do so merely by acting on an upper face of the push-control member. Due to friction between the user's finger and the upper face of the said push-control member, or due to an adapted form of this push-control member, it can be moved transversely, and then, without moving the finger in relation to the push-control member, the user simply presses on it to operate the lighter.

Of course, the present invention is not limited to the implementations described above by way of examples, instead it embraces all variations.

So for example, a lighter in accordance with the present invention does not have to be one with piezoelectric lighting. This lighter can include a lighting mechanism of a type with 6a flint and knurling-wheel. Rotation of a said knurling-wheel is then obtained by pressing down on a push-control member.

In the examples of implementation given, elastic means enabling return of the push-control member to its idle position in a transverse direction are integrated into a component of the lighter, such as the push-control member itself or the body of this lighter, or an electrode. These are preferred implementations, nevertheless means concerned can easily comprise one independent part, such as, for example, a helical spring, without departing from the present invention.

I claim:

1. Lighter actuated by a push-control member (24) which can move in a longitudinal direction, and which resists use by children, of a type comprising a lighter-body (2) and lighting means comprising a push-control member, characterised in that the push-control member (24) is guided in two essentially perpendicular directions, a first direction (36) which is longitudinal in relation to a said lighter-body (2) and a second direction which is transverse (38, 56, 60) in relation to the same body (2), and in that the said push-control member (24) is provided with an abutment face (32, 46, 52, 53) which is normally opposite a counter-abutment surface (34, 44, 2) which is integral with the said lighter-body (2), and in that the said push-control member (24) can be moved in a transverse direction (38, 56, 60) such that its abutment face is then in a non-active position relative to its counter-abutment surface, and in that elastic means (40, 54, 58, 41, 62) act in a transverse direction (38, 56, 60) to return the said abutment face of the push-control member to a position opposite the said counter-abutment surface, means being provided to return the said push-control member into a position of rest in the longitudinal direction.

2. Lighter in accordance with claim 1, characterised in that elastic means act on the push-control member (24) on the side opposite the side carrying the abutment face.

3. Lighter in accordance with claim 1, characterised in that elastic means comprise an elastic tongue-member (40, 58, 41) essentially extending in the longitudinal direction of the lighter-body, which can be deformed in a transverse direction by transverse movement of the push-control member (24) and which functions in combination with this push-control member (24).

4. Lighter including a piezoelectric lighting-mechanism in accordance with claim 1, characterised in that said elastic means comprise a metal strip (54), which is essentially U-shaped forms branches, carried by a wall (22) which is part of the lighter body (2) and positioned nearly parallel to the wall (48) of the said push-control member, one of the branches of the said strip being supported against the wall of this push-control member and being elastically deformable, a second branch being curved at its end and acting as an electrode (20), and in that the piezoelectric lighting mechanism (12, 14) has at least one section made from conductive material such that it can create an electrical link with said metal strip at the end of the longitudinal course of the push-control member (24).

5. Lighter in accordance with claim 1, characterised in that said elastic means comprises an elastic tongue-member (62) extending essentially in the longitudinal direction of the lighter and being deformable in the transverse direction of movement of the push-control member (24) and being integral with an electrode-carrier (22).

6. Lighter in accordance with claim 5, characterised in that the elastic tongue-member (62), mounted on the electrode-carrier (22), is separable from the electrode-carrier and movable away from the electrode-carrier in an upward direction.

7. Lighter in accordance with claim 1, characterised in that the abutment face is implemented level with a shoulder (32, 52, 53) of the push-control member.

8. Lighter in accordance with claim 1, characterised in that the counter-abutment face is the top of a rib (44, 66) which runs essentially longitudinally, and the said push-control member (24) includes a wall-member forming a projection (46, 64), parallel to the said rib-member (44, 66), with a height whereby, when the push-control member is moved in a transverse direction (38, 56), away from its idle position, it does not come up against the said rib (44, 66), and placed such that when the said push-control member (24) is moved from its idle position in a longitudinal direction (36, 56), an internal surface of the wall-member concerned, forming a projection, slides along the said rib-member.

9. Lighter in accordance with claim 1, characterised in that longitudinal guiding of the push-control member (24) is favourably implemented with the aid of a system of ribs each of which is associated with a groove, the said push-control member (24) being provided with two rib-members and the lighter-body (2) concerned being provided with two corresponding grooves, said grooves stopping below said rib members in the idle position of the push-control member (24) and being shifted transversely in relation to these, such that the ribs concerned are engaged in the corresponding grooves when the push-control member (24) has been moved transversely and starts its longitudinal course.

* * * * *